United States Patent [19]

Bartasius

[11] Patent Number: 4,997,185

[45] Date of Patent: Mar. 5, 1991

[54] BALL-RETAINING TENNIS NET

[76] Inventor: Joseph A. Bartasius, 3713 Valley Park Way, Lake Worth, Fla. 33467

[21] Appl. No.: 529,335

[22] Filed: May 29, 1990

Related U.S. Application Data

[63] Continuation-in-part of Ser. No. 412,119, Sep. 25, 1989, Pat. No. 4,948,129, which is a continuation-in-part of Ser. No. 300,589, Jan. 23, 1989, Pat. No. 4,895,366.

[51] Int. Cl.[5] ..... A63B 6/00

[52] U.S. Cl. ..... 273/29 B

[58] Field of Search ..... 273/29 B, 29 A

[56] References Cited

U.S. PATENT DOCUMENTS

| | | | |
|---|---|---|---|
| 2,280,376 | 4/1947 | Clark | 273/29 A |
| 2,615,715 | 10/1952 | Moore | 273/29 B |
| 3,215,432 | 11/1965 | Lee et al. | 273/29 A |
| 3,966,205 | 6/1976 | Schain et al. | 273/29 A |
| 4,025,071 | 5/1977 | Hodges | 273/29 A |
| 4,073,491 | 2/1978 | Sepaniac | 273/29 B |
| 4,204,679 | 5/1980 | Kreuzman | 273/29 A |
| 4,243,221 | 1/1981 | Godinho | 273/29 A |
| 4,456,252 | 6/1984 | Hartland | 273/29 A |

*Primary Examiner*—Theatrice Brown
*Attorney, Agent, or Firm*—Victor F. Volk

[57] ABSTRACT

A ball-entrapping tennis net of the type that is comprised of two open meshworks that are each lined with strips of conventional netting is improved by bindings that hold the two meshworks together at both ends of the net.

9 Claims, 2 Drawing Sheets

2
31
10
29
11
33
13
32
34
38
35
12
13
36
2

BALL-RETAINING TENNIS NET

This application is a continuation-in-part of application S.N. 412,119, filed 09/25/89, now U.S. Pat. No. 4,948,129 which was a continuation-in-part of application S.N. 300,589, filed 01/23/89, now U.S. Pat. No. 4,895,366.

BACKGROUND OF THE INVENTION

In my U.S. Pat. No. 4,895,366 a ball-retaining net is described comprising two spaced-apart meshworks, each of which is lined with horizontal strips of netting. To keep the meshworks apart they were ties to opposite sides of the net-supporting posts. It was believed that the meshwork assemblies should be separated to provide space for the balls to enter behind the strips and, indeed, this separated net performs very well. However, I have now discovered that the net also traps balls if the meshwork-strip assemblies are permitted to hang freely together, and believe that this results from the fact that after a ball passes through one of the meshworks it usually has enough momentum to push back the opposing strip assembly sufficiently to become entrapped.

The improved net has the advantage that it appears more like a standard, non-entrapping net and much more closely approximates a two-dimensional surface.

SUMMARY OF THE INVENTION

I have invented a tennis net that comprises a pair of open meshworks each having a plurality of vertical and horizontal strands that define openings large enough to permit free passage of a standard tennis ball. The long upper edges of these two meshworks are connected together, preferably by a folded tape, so that they can be suspended from a cable, and a plurality of horizontal strips are affixed to each of the meshworks by stitching an upper edge of a strip to one of the horizontal strands of a meshwork. The strips are wide enough to cover the openings and overlap each other with the result that when a ball strikes the net it passes through an opening in one of the meshworks and pushes back the adjacent strip, using up its momentum, so that it drops down within the net rather than rebounding onto the tennis court.

In the present improvement the short edges of the meshworks are held together, such as by folded tapes, so that the two pluralities of strips are normally in contact with each other. The taped edges of the meshworks can advantageously be tied under tension to end posts on the tennis court. This has the advantage that the net retains a conventional appearance and is not much thicker than a standard net, although, surprisingly, it still catches the balls that strike it. Where a tie-down tape is used it loops over the cable and the uppermost strip but hangs between the two opposing pluralities of strips.

DETAILED DESCRIPTION OF A PREFERRED EMBODIMENT

Figure 1:
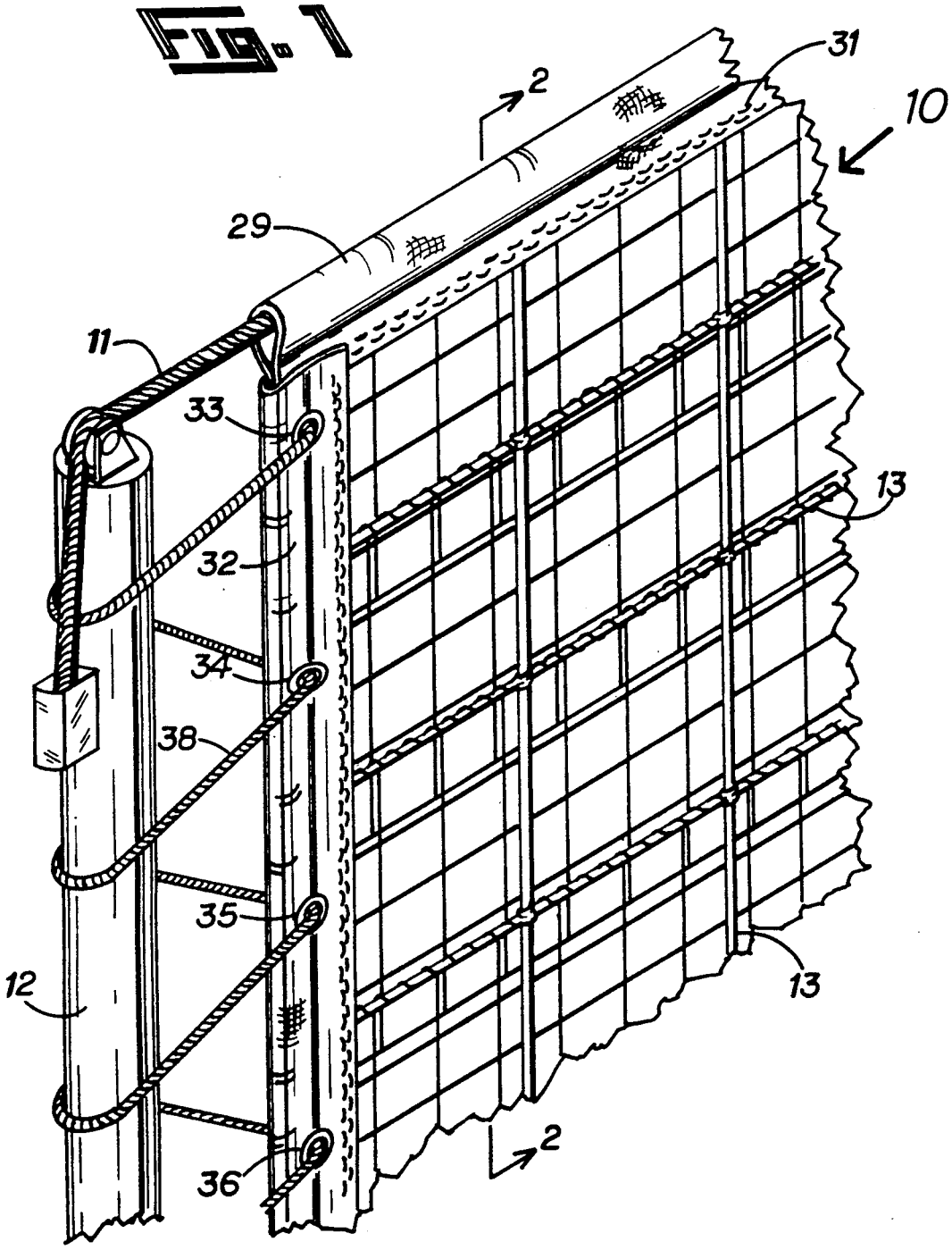
FIG. 1 is a pictorial view at, an end post, of the net of my invention.
Figure 4:
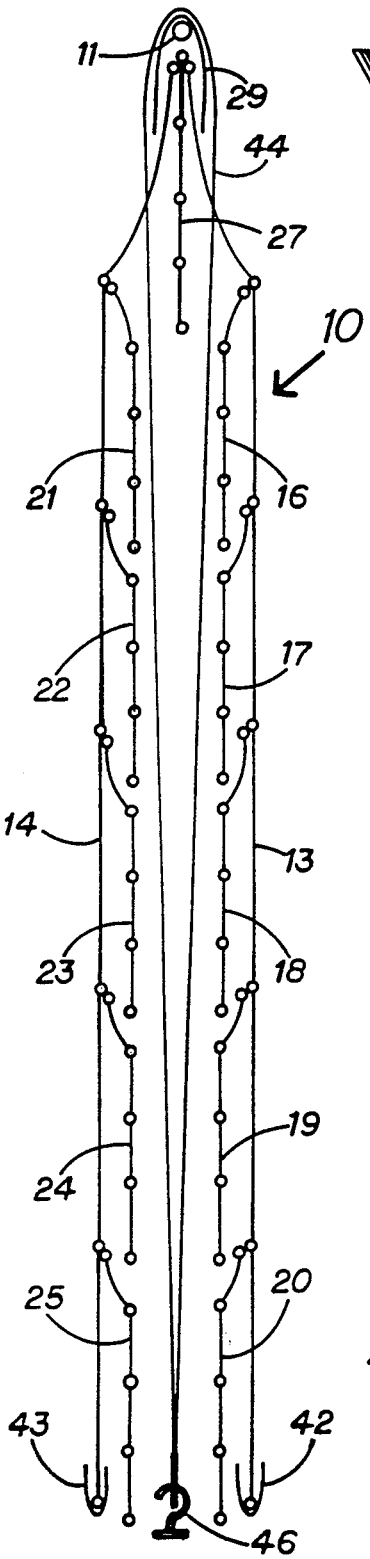
FIG. 4 is a diagrammatic section through the lines 4—4 of FIG. 3.
Figure 2:
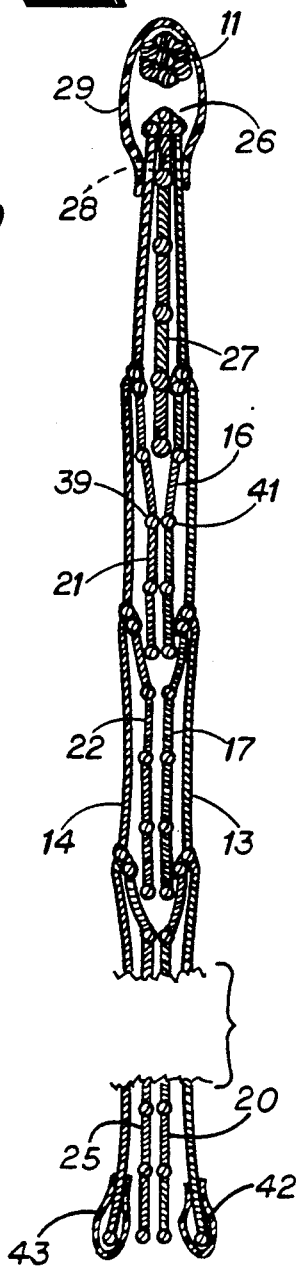
FIG. 2 is a vertical section through my net at the lines 2—2 of FIG. 1 with an additional bottom portion shown.
Figure 3:
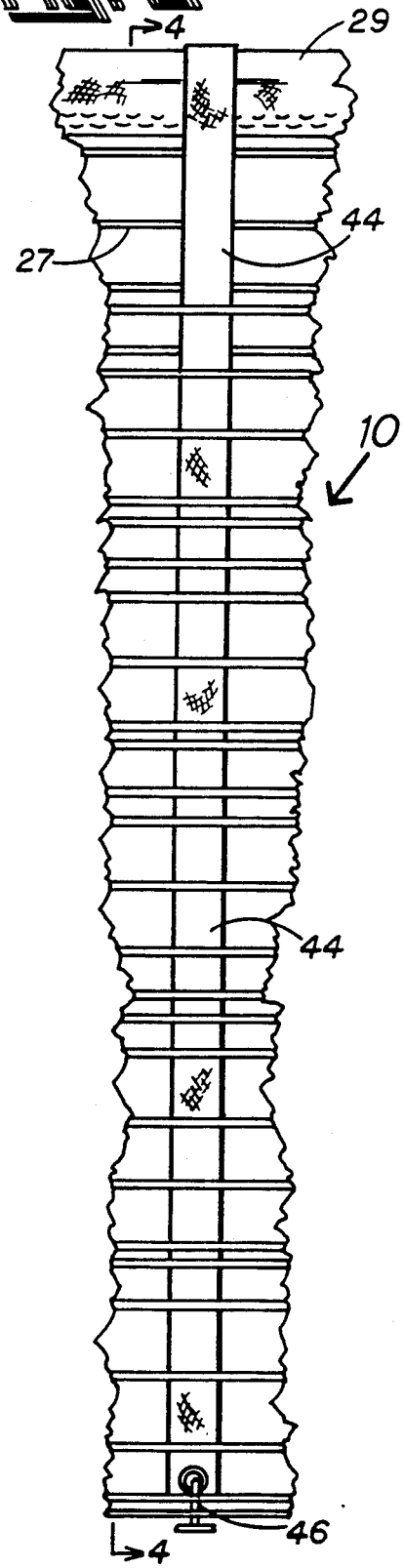
FIG. 3 is a side elevation of a portion of my net at the central tensioning tape with the vertical strands of net deleted for clarity.

Referring first to FIG. 1 my tennis net 10 is suspended from a cable 11 between two posts of which only the post 12 is depicted. The net comprises an open meshwork 13 and a matching network 14 (FIG. 2) each of which is lined by a plurality of strips 16, 17, 18, 19, 20, and 21 and 22, 23, 24, 25, respectively. The strips 16–25 may be made of cloth or plastic sheeting but, preferably for proven performance and greater transparency, are comprised of standard tennis netting such, preferably, as a #420 knotless nylon with $1\frac{3}{4}$ inch (4.45 cm) squares, and each strip is fastened such, preferably, as by stitching (merrowing 26) to one of the horizontal strands of the meshworks 13 and 14, which also comprise #420 nylon, but with 6-inch (15 cm) squares.

An uppermost strip 27 is stitched between both of the meshworks 13,14 and also, by the stitching 28, to a folded horizontal tape 29 which encloses the cable 11 and supports the net therefrom. Multiple rows of stitching 31 secure the meshworks 13, 14 and strip 27 within the fold of the tape 29 which supports them. A vertical folded tape 32 encloses and is stitched to the meshworks 13, 14, strips 16–25, and strip 27, bringing the two pluralities of strips in contact with one another. The tape 32 may be canvas or plastic, such as vinyl, and is perforated by eyelets 33–36 through which it is lightly tensioned to the post 12 by a cord 38. An equivalent tape and cord lash the other end of the net 10 to an equivalent post, not shown, across the court. Protective tapes 42 and 43 are applied to the bottoms of the respective meshworks 13, 14.

The strap 44 which holds the net at center court to the required height is looped over the cable 11 and tape 29 and the top strip 27 but passes behind the two meshworks 13, 14 and their attached pluralities of strips 16–20 and 21–25. The strap 44 is drawn downwardly to a fixed hook 46.

OPERATION

My net 10 has proven surprisingly effective at retaining balls in play, although it had previously been believed that an inner separation of the two mesh-strip assemblies would be required to permit striking balls to enter. Apparently, when a ball strikes the present net it is permitted to enter by a combination of a slight movement of the opposing meshwork and a slight bulging of the opposing strip through the large network opening. Since the vertical tape 32 is outside the lines of the court, proper, it, and its mate at the opposite end, are a negligible hindrance to these movements. In play, most of the balls that strike the net are service balls which, typically, strike it with great force, and this has no doubt contributed to the practical usefulness of the present invention in reducing the danger of stray balls on the court.

The closeness of the strips to each other contributes to an improved transparency since individual strands, such as strands 39, 41, (FIG. 2) of opposing strips present a single obstruction to the line of sight when they come together. My net 10 is not distractingly different from conventional nets and, because of its compactness, does not significantly change the dimensions of the playing area.

The foregoing description has been exemplary rather than definitive of my invention for which I desire an award of Letters Patent as defined by the appended claims.

I claim:

1. In a tennis net comprising:

a first and second substantially rectangular shaped meshwork, each of said meshworks being comprised of a plurality of interconnected horizontally and vertically extending strands, said strands defining openings large enough to permit passage of a standard tennis ball, said first and second meshwork being attached together along their upper longitudinal edges, the remaining portions of one said meshwork being movable relative to the remaining portions of the other said meshwork so as to permit the downward passage of a ball between them, said meshworks being suspended by a substantially horizontal cable attached to said upper edges, and two pluralities of flexible barrier strips, each said plurality of strips covering one said meshwork and both of said pluralities of strips hanging between said meshworks, said strips comprising upper and lower edges, the upper edge of each of said strips being fastened lengthwise to one of said meshworks strands and the lower edge of each of said strips hanging free, the width of each of said strips exceeding the vertical dimension of said openings in the meshwork to which it is fastened, whereby balls passing through said meshworks openings will be deflected downwardly between said meshworks by said strips, the improvement in combination therewith comprising, means holding together the short edges of said meshworks at both ends thereof.

2. The tennis net of claim 1 wherein said holding means comprise folded tapes.

3. The tennis net of claim 1 wherein an uppermost strip is fastened between and to both of said meshworks.

4. The tennis net of claim 1 wherein said strips are fastened to consecutive of horizontal strands of said meshworks.

5. The tennis net of claim 1 comprising end posts supporting said cable and tension means connecting said meshworks to said end posts.

6. The tennis net of claim 1 wherein said strips comprise netting.

7. The tennis net of claim 1 wherein said openings are about 6 inches (15 cm) square.

8. The tennis net of claim 5 wherein one said plurality of strips is in facing contact with the other said plurality of strips throughout substantially the length and width thereof.

9. The tennis net of claim 3 including a vertical net center height adjusting strap, said strap being looping over said cable and said uppermost strip and extending between both said first and second meshworks and means for attaching said height adjusting strap to a tennis court surface.

* * * * *